United States Patent [19]

Larson

[11] 4,228,330

[45] Oct. 14, 1980

[54] TOUCH PANEL MECHANISM

[75] Inventor: Gerald L. Larson, Minnetonka, Minn.

[73] Assignee: Litton Systems, Inc., Beverly Hills, Calif.

[21] Appl. No.: 923,305

[22] Filed: Jul. 10, 1978

[51] Int. Cl.[3] ..... H01H 13/70

[52] U.S. Cl. ..... 200/5 A; 200/DIG. 1

[58] Field of Search ..... 200/5 A, 159 B, 292, 200/86 R

[56] References Cited

U.S. PATENT DOCUMENTS

| | | | |
|---|---|---|---|
| 3,591,749 | 7/1971 | Comstock | 200/5 A X |
| 3,718,791 | 2/1973 | Szablowski | 200/86 R X |
| 3,860,771 | 1/1975 | Lynn et al. | 200/5 A |
| 3,862,381 | 1/1975 | Glaister et al. | 200/5 A |
| 3,862,382 | 1/1975 | Glaister et al. | 200/5 A |
| 3,898,421 | 8/1975 | Suzumura | 200/5 A X |
| 3,909,564 | 9/1975 | Scheingold et al. | 200/292 X |
| 4,065,649 | 12/1977 | Carter et al. | 200/5 A |
| 4,066,851 | 1/1978 | White et al. | 200/5 A |
| 4,066,852 | 1/1978 | Zenk | 200/5 A |
| 4,071,718 | 1/1978 | Harden | 200/5 A |
| 4,145,584 | 3/1979 | Otterlei | 200/5 A |

*Primary Examiner*—James R. Scott

*Attorney, Agent, or Firm*—Robert E. Lowe; Nate F. Scarpelli

[57] ABSTRACT

An improved touch panel switching device including a thin, flexible plastic sheet foldable to locate respective switch contactors and contacts opposite each other, an insulating spacer member intermediate the switch contactors and contacts and having openings to enable contactor and contact communication, a rigid backing on one side and a thin, metal sheet on the other side of the plastic sheet, the metal sheet being relatively stiff and depressable at a switch position to enable engagement of a respective switch contactor and contact.

10 Claims, 5 Drawing Figures

TOUCH PANEL MECHANISM

This invention relates to touch panel switch devices and in particular to touch panels using touch actuated membrane type switches.

BACKGROUND OF THE INVENTION

Reference may be made to the following U.S. Pat. Nos. of interest: 3,383,487; 3,860,771; 3,862,381; 3,862,382; 4,017,848; 4,056,699; and 4,066,851.

Currently, the most commonly used types of touch actuated panel switch devices comprise either the glass-capacitive or the flexible plastic membrane type switches. The glass-capacitive touch panel switches are presently employed in elevators for selecting floors, in microwave ovens for selecting various oven control or display functions, etc. They offer the advantage of being readily imprinted with desired graphic information, thereby presenting a smooth, aesthetic panel effect, while also having a desirable tactile effect in operation. On the other hand, the glass panels are relatively expensive to construct, difficult to interface with electronic control circuits and subject to relatively easy breakage. In addition, the "touch" operating reliability of the capacitive type switches employed is subject to humidity, temperature, human physiology factors, and other conditions so that at times several attempts at switch actuation must be made before the switch operates.

Touch actuated membrane type switches employ printed circuit contactors on a flexible, thin plastic surface aligned over printed switch contacts positioned on an opposite non-conductive surface, with an insulating spacer between having holes in registration with each switch contact position. The flexible plastic surface is deflected over a spacer hole to move the switch contactor between about 10–25 mils to engage the contactor with its associated contact. Such membrane type switches while less expensive to construct and generally more reliable in switching operation than the glass-capacitive touch switches, present several problems of their own when utilized in touch actuated panels.

In particular, the plastic front panel, usually formed of a thin, flexible polyester sheet, cannot be graphically imprinted as well nor is it as pleasing in its aesthetic appearance compared to the smooth glass panels. Also, the rather spongy feeling during "touch" operation is an undesirable tactile aspect when compared to a "touch" operated smooth glass panel. In addition, the flexible front panel plastic sheet is readily subject to damage from sharp objects and to undesirably enabling contact with a small but possibly deadly voltage on the printed circuit conductors. Some membrane switches incorporate a vent or air channel to couple the air space in each spacer hole to the atmosphere so as to allow deformation of the flexible front panel without requiring an undesirably excessive amount of deflecting pressure to be exerted or in an attempt to eliminate the spongy switch operation. Yet, many applications require these switches to be placed in a generally hostile environment—high temperatures, high moisture conditions, or a greasy, dirty or dusty situation, and thus, such hostile environment could adversely affect the switch operating reliability.

A significant further disadvantage is the requirement to registerably align each of the spacer holes with a respective switch contact position during assembly and to provide means for maintaining this precise alignment.

While each spacer hole could be made larger to more readily enable alignment with the respective switch contacts, too large of a hole would permit the flexible sheet to depress over too large of an area and thereby undesirably operate two or more switches rather than only the one switch desired. On the other hand, in order to reduce the possibility of undesirably operating two switches when only one is desired, the spacer hole should be made as small as possible. However, reducing the spacer holes leads to increasing the problem of aligning a respective hole with its contacts.

It is therefore desired to provide a touch panel switch device combining the respective advantages of glass type capacitive switches and of the depressable plastic type membrane switches without the disadvantages of either.

SUMMARY OF THE INVENTION

In accordance with the principles of the present invention, there is provided a touch panel switch device having a front panel permitting a wide choice of readily imprinted graphics and yet which is safe, durable and not subject to easily being penetrated or destroyed. In addition, the touch panel switch device of the present invention does not require any venting to the atmosphere so that the switch contacts can be sealed from any hostile environment.

The touch panel switching device of the present invention employs membrane type switches with a plurality of switch contact positions. An insulating spacer is located intermediate the contacts, with the spacer having apertures extending over a plurality of switch contact positions. Thus, the panel components can be readily assembled since the spacer holes do not have to be aligned with each of the switch contacts. A thin, relatively stiff metal sheet forms the front panel. The metal sheet is sufficiently stiff so as to be "touch" depressable at a switch contact position to only enable engagement of the respective switch contacts associated therewith. As will be described hereinafter, several factors, including the desired "touch" switch operating force, switch travel distance, spacer thickness and spacer hole diameter, are involved in determining the characteristics of the metal front panel required to attain the desired tactile effects.

In a constructed embodiment of the invention, the switch contacts are about 5 mils part and a 12 mils thick, ¾ hardness, aluminum front panel sheet could be depressed with 0.3 to 1.5 pounds of operating force to obtain reliable switch operation.

DETAILED DESCRIPTION

As indicated, FIGS. 1–5 illustrate a preferred embodiment of the present invention adapted for use as a front control panel for a microwave oven. It is to be understood, of course, that this illustration and the following description is presented for the purpose of providing a complete description of the invention, since the invention can readily be adapted for use in other environments, such as elevators, etc. where the significant advantages afforded by the present invention may be desired.

Figure 1:
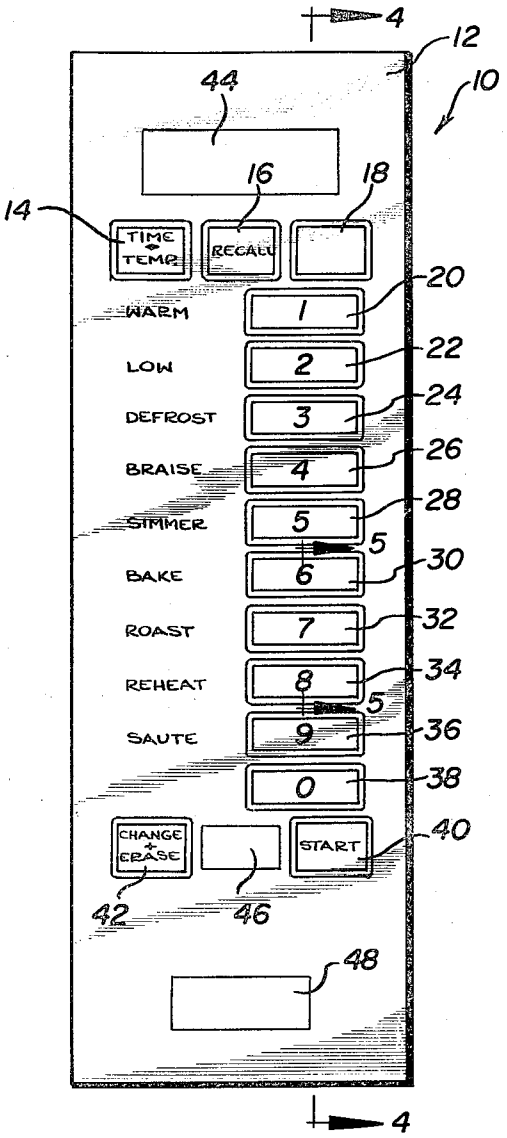
FIG. 1 is a front elevational view illustrating a touch panel switching device constructed in accordance with the principles of the present invention and embodied for illustrative purposes as a front panel of a microwave oven.

A touch panel switching device 10 incorporating the present invention includes a metal front panel 12 having graphical indicia placed thereon relating to the adaptation of the panel to a microwave oven as shown in FIG. 1. In particular, specific indicia 14, 16, 18, etc. through specific indicia 42, are imprinted or otherwise placed on the front panel face so as to correlate with a respective touch switch position. Apertures 44, 46 and 48 are provided in the panel 12 to accommodate display units, door release handles, "on-off" button switches, or other units for the desired functions.

Figure 2:
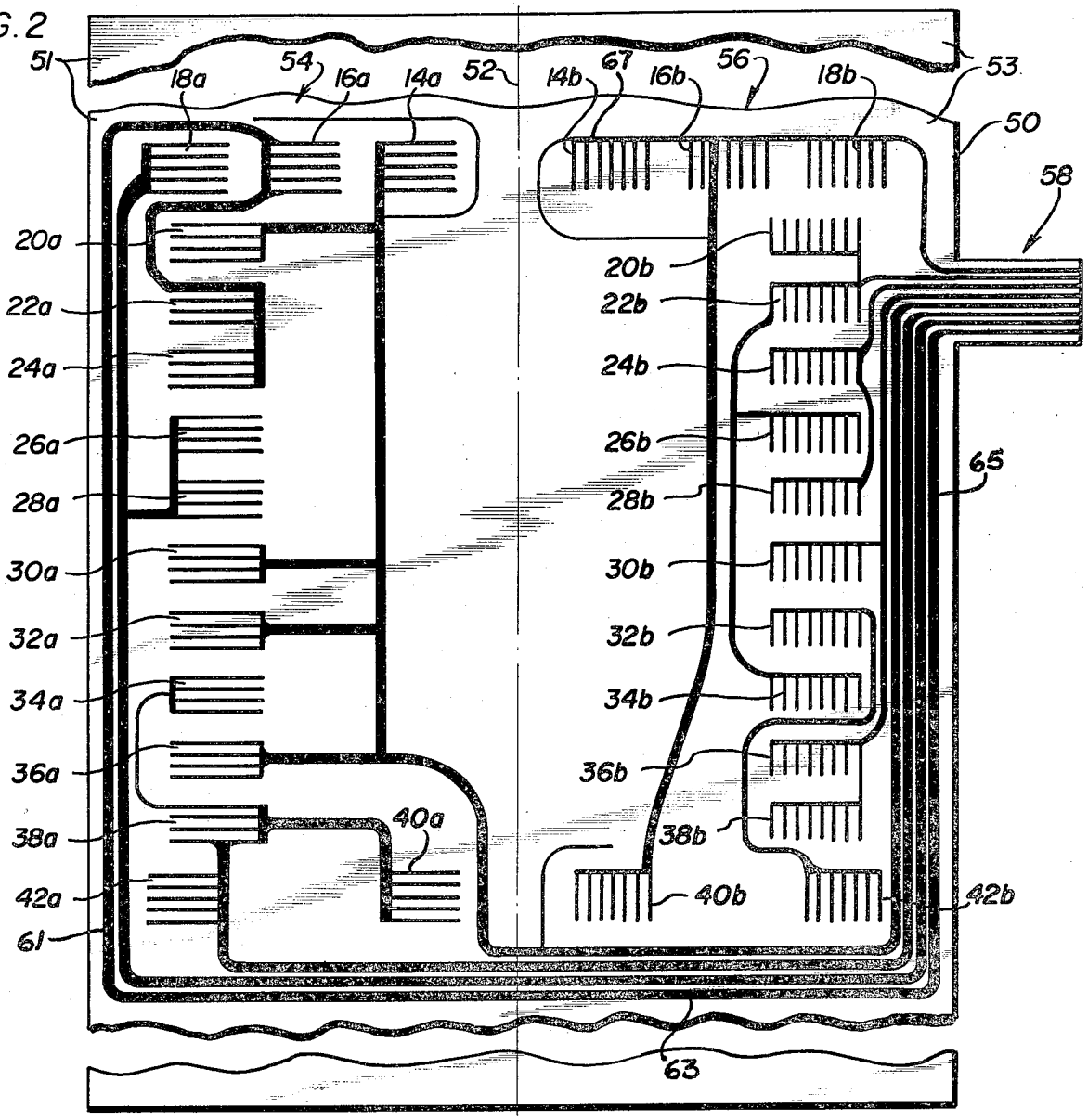
FIG. 2 is an elevational view illustrating the circuit layout of conductor members on a thin insulating sheet, with the sheet foldable along the indicated center line to form respectively opposite switch contactors and switch contacts.

FIG. 2 shows a thin plastic sheet 50 comprising two half sections 51 and 53 divided by center line 52 and having respective conductor layouts 54 and 56 located on each half section extending to a terminal connecting tab portion 58. The sheet 50 can be formed of Mylar, or of any plastic material such as polyester, etc. providing the flexibility and resiliency required. The conductor layouts 54 and 56 may be screen printed or otherwise placed on the surface of sheet 50 using standard techniques.

Conductor layout 54 includes a series of finger-like switch contactors correlated to the switch indicia positions 14 through 42 on panel 12. For convenience, the switch contactors included in conductor layout 54 have been indicia with reference numerals **14*a*, 16*a*, 18*a*, etc. through 42*a*. Similarly, conductor layout 56 includes a series of finger-like switch contacts 14*b*, 16*b*, 18*b*, etc. through 42*b* providing more than one contact point at each switch position. It may be noted from FIG. 2, that the respective switch contactors can be placed directly over the associated switch contacts by folding flexible sheet 50 along the center line 52**.

Figure 3:
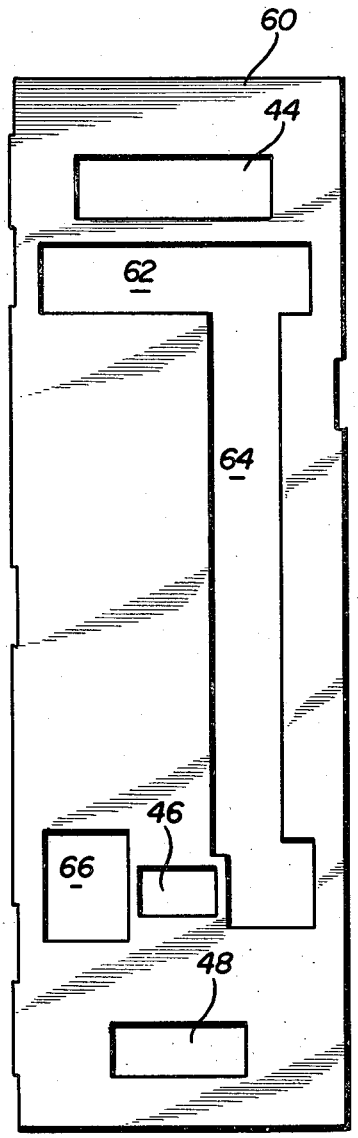
FIG. 3 is an elevational view illustrating a thin insulating spacer member insertable between the foldable switch member shown in FIG. 2.

A thin, insulating spacer member 60 is adapted for insertion between half sections 51 and 53 and thus between conductor layouts 54 and 56 when the flexible sheet 50 is folded along the center line 52. Spacer member 60 includes respective cutout portions 62 and 64 as shown in FIG. 3. Cutout portion 62 is located on spacer 60 so as to encompass the switch contact positions 14, 16 and 18; whereas cutout portion 64 encompasses switch contact positions 20, 22, etc. through 40. Cutout portion 66 corresponds to the contact switch position 42. Thus, spacer member 60 when placed between the folded sheet sections 51 and 53 non-conductively isolates the conductor layouts 54 and 56 and separates the switch contactors from the switch contacts otherwise communicable in cutout portions 62, 64 and 66.

Figure 4:
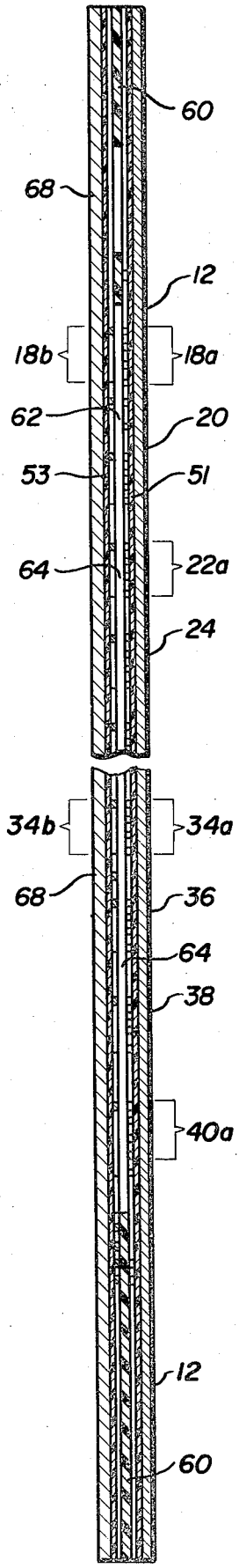
FIG. 4 is a sectional view taken along section lines 4—4 of FIG. 1 and illustrating the metal front panel, the folded switch member of FIG. 2 with the spacer of FIG. 3 inserted therebetween, and a rigid back panel element, with the switch contacts being in the non-operated position.

FIG. 4 illustrates the touch panel switch device having been assembled by bonding the individual components together. That is, spacer member 60 is inserted between the folded sections 51 and 53 of sheet 50 and is bonded thereto with suitable adhesive sealing means. Folded sheet 50 and spacer 60 are then placed intermediate metal front panel 12 and a rigid rear panel member 68. All of the components are then bonded together using suitable adhesive sealing means to conform to the assembly shown in FIG. 4 with all of the switches being in the non-operative position.

With reference to FIG. 2, it can be seen that the conductor layouts 54 and 56 include several longer and wider conductive lines such as 61, 63, 65, 67, etc., surrounding the shorter and narrower switch contactors and contacts. This conductor layout minimizes any switch contact contamination in the event of loss of sealing. With loss of sealing gases with water vapor or other contaminants may find their way into the switch contact areas. However, the longer and wider non-switching conductors 61, 63, 65, 67, etc. form a series of "walls" around the switch contacts so that the contaminants must pass over them before reaching the switch contact areas. Thus, the surrounding conductors act as a "getter" collecting any undesirable contaminants and thereby protecting the more sensitive switch contact areas.

Figure 5:
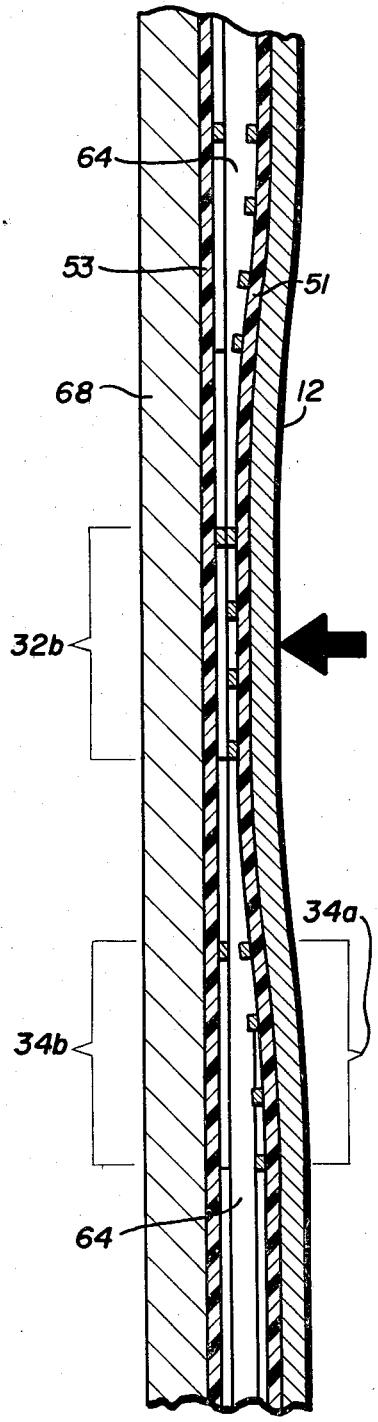
FIG. 5 is an enlarged, fragmentary sectional view taken along the section lines of 5—5 of FIG. 1 and illustrating three switch contact positions with the middle switch contactors engaging the associated switch contacts by depressing and thereby deflecting the metal front panel as shown.

In the expanded view of FIG. 5, the reference arrow indicates a slight force depressing metal sheet 12 so as to urge switch contactors **32*a* into engagement with switch contacts 32*b*. It is to be particularly noted in FIG. 5 that the adjoining switch contacts 30 and 34 are not engaged, in spite of the fact that there is no insulating material provided between each switch contact position. This operation is assured by providing an extremely small space between the contactors and contacts of a respective switch, while also providing a metal sheet 12** of suitable material having the required thickness and stiffness characteristics.

To obtain the characteristics of the various panel components, it is desired to utilize the following criteria: (1) Switch "touch" operating force range from approximately 0.3 to 1.5 pounds; (2) Switch travel range approximately 0.003 to 0.008 inch; and (3) Switch operating reliability over 100,000 plus switch cycles. Item (2) fixes the spacer 60, plus the adhesive, thickness. Consequently, adjusting the spacer hole diameter and metal thickness results in the desired switch operating force. Possible metal thicknesses range from about 0.005 to 0.015 inch. In practice, metal thickness less than about 0.010 inch may not be practical due to handling difficulties and the possibility of damage during manufacture. The limiting factor relative to spacer hole diameter versus metal thickness is the metal operating life, i.e., for the desired 100,000 plus switch operations, the material endurance of fatigue limit must be avoided. In practice, a ¾ hardness aluminum sheet, ranging between 0.008 to 0.015 inch thick is usable with spacer holes ranging from 0.75 to 1.5 inch diameter, and a switch travel range from 0.003 to 0.008 inch.

In a constructed preferred embodiment of the invention, spacer 60 comprised of a 3 mils thick Mylar sheet and with 1 mil of adhesive material on each side thereof, the separation between contactors and contacts of a respective switch was 5 mils. Although this contact separation is substantially less than the 10–25 mils separation in prior art membrane type switches, reliable switch operation was assured without the need for registration between individual spacer holes and an individual switch contact position by using a 12 mils thick aluminum, ¾ hardness front sheet member 12. The constructed touch panel device required only about 0.3 to 1.5 pounds of finger supplied "touch" operating force. Any similar type of metallic material can of course, be utilized for the front panel member 12 such as steel, copper, gold, tin, or alloys thereof having the desired stiffness or spring rate, and therefore requiring only a small travel distance when depressed with a light finger touch operating force to insure reliable switch operation.

Rear panel 68 in the constructed version comprised an aluminum sheet about 62 mils thick which provided sufficient rigidity to prevent undesired flexing of the conductor layout 56 during touch finger actuation of the panel. It is understood, of course, that other metallic or non-metallic materials could be utilized for rear panel 68 to supply the required rigidity during switch operation. Also, if desired, rather than employing a separate rear sheet 68, the remaining touch panel components can be located against a rigid member or frame portion when mounted for use on the unit to supply the required rigidity.

Thus, the touch panel switch device of the present invention provides several advantages over prior art type touch switches without incorporating any of the disadvantages. This panel provides desirable aesthetic and tactile characteristics of flat, glass panel capacitor type switches with the reliability of membrane switches. Yet, the present panel is more resistent to destruction than prior panels and if one succeeds in puncturing the front metal panel 12, the puncturing instrument will simply be shorted to ground through the panel thus providing a safely feature not found in the prior art.

Modifications to the illustrated panel are within the skill of the art. For example, rather than utilizing the folded conductor layout sheet 50, two separate printed circuit elements such as the portions 51 and 53 can be used. In addition, it is possible to use only one switch contact portion 51 and 53 with the metal panel 12 grounding the desired contact. Also, rather than using one output wire per switch, simple encoding by arranging the printed circuit elements to provide two or more grounding outputs for each switch can reduce the number of output wires required. Furthermore, using the metal panel grounding technique, a conventional printed circuit board containing the switch elements can be used, thereby eliminating the thin, flexible sheet 50 and back panel 68.

While the spacer 60 shown in FIG. 3 incorporates the cutout portions 62 and 64 encompassing more than one switch contact position, it is possible to use distinct holes (such as hole 66) associated with each switch position. In particular, such panels have been constructed in which the spacer holes are very close together so that only a thin strip of insulating material separates and thus defines each hole. The limiting factor, of course, is the stiffness or spring rate of the metal panel 12, since if the holes are very small, the metal panel may be too stiff to flex sufficiently to enable the contacts to engage. This may be somewhat modified by embossing the metal panel 12 in the vicinity of the switch positions to enable a wider range of metal thickness and spacer hole diameter selections. The use of embossing also enables more panel design or styling versatility. In any event, whether the spacer incorporates cutouts encompassing more than one switch position or has individual cutouts for each switch position, or embossing is utilized, all of the aforementioned aesthetic, tactile characteristics, reliability, and economy of production are realized by this invention over prior art touch panel type switches.

The foregoing detailed description has been given for clearness of understanding only and no unnecessary limitations should be understood therefrom as modifications will be obvious to those skilled in the art.

What is claimed is:

1. In a touch panel switch device having switch contactors positioned on a flexible, non-conductive surface aligned with respective switch contacts positioned on an opposite non-conductive surface to provide a plurality of switch contact positions, said flexible surface being depressable to enable engagement between a respective contactor and contact, the improvement comprising:

a non-conductive spacer intermediate said surfaces including apertures therein extending over more than one of said switch contact positions; and a thin metal sheet overlying and immediately adjacent said flexible, non-conductive surface, said metal sheet being depressable at a switch contact position to depress said non-conductive surface and only enable engagement of the respective contactor and contact associated therewith wherein the thickness of said non-conductive spacer and the stiffness of said thin metal sheet combine to provide said touch panel switch device with the hard tactile feel characteristic of glass-capacitive touch panels.

2. In a touch panel switch device having switch contactors positioned on a flexible, non-conductive surface aligned with respective switch contacts positioned on an opposite non-conductive surface to provide a plurality of switch contact positions, and including a non-conductive spacer maintaining said switch contactors spaced from said switch contacts in the switch non-operative mode, said flexible surface being depressable to enable engagement between a respective contactor and contact in the switch operative mode, the improvement comprising:

a thin, metal sheet overlying and immediately adjacent said flexible, non-conductive surface, said metal sheet having a thickness at least equal to said space between said switch contactors and contacts in the switch non-operative mode, and said metal sheet being depressable at a switch contact position to depress said non-conductive surface and only enable engagement of the respective switch contactor and contact associated therewith, said metal sheet having sufficient stiffness to provide a substantially firm tactile operating characteristic to said touch panel as said switches are depressed.

3. In a touch panel switch device having switch contactors positioned on a flexible, non-conductive surface aligned with and spaced by an insulating spacer from respective switch contacts positioned on an opposite non-conductive surface to provide a plurality of switch contact positions, said flexible surface being depressable to enable engagement between a respective contactor and contact, the improvement comprising:

a thin, metal sheet overlying and immediately adjacent said flexible, non-conductive surface, said metal sheet having sufficient stiffness characteristics to be depressable at a switch contact position and only enable engagement of the respective switch contactor and contact associated therewith, and to provide a firm, tactile feel to said touch panel switch device as said switch contacts are operated, whereby movement of said flexible, non-conductive surface is substantially imperceptible to the operator.

4. A touch panel switch device according to claim 2, wherein said metal sheet thickness is about 0.008 to 0.015 inch and said space between said switch contactors and contacts in the switch non-operative mode is about 0.003 to 0.008 inch.

5. A touch panel switch device according to claim 2, wherein said metal sheet thickness is about 0.012 inch and said space between said switch contactors and contacts in the switch non-operative mode is about 0.005 inch.

6. A touch panel switch device according to claim 3, wherein said metal sheet comprises ¾ hardness aluminum.

7. A touch panel switch device according to claim 6, wherein said metal sheet has a thickness about 0.012 inch and said respective switch contacts are spaced about 0.005 inch apart.

8. A touch panel switch device according to claims 2 or 3, wherein said spacer includes apertures therein extending over more than one of said switch contact positions.

9. A touch panel switch device comprising:

a non-conductive surface having a plurality of conductive switch contacts thereon defining respective switch contact positions;

means for maintaining said non-conductive surface rigid during operation of said switch device;

an insulating spacer adjacent said non-conductive surface having apertures therein at said switch contact positions;

a relatively stiff metal sheet adjacent said insulating spacer on the side opposite from said switch contacts, said metal sheet having sufficient stiffness characteristics to be depressable at a switch contact position to only enable engagement of said metal sheet with the switch contacts associated with said switch position and to provide a substantially firm tactile feel to said touch panel during depression of said switch contacts.

10. A touch panel switch device having the hard, non-tactile feel of glass capacitive touch panels but incorporating the switch operation of flexible membrane switches, said device comprising:

a substantially rigid backing member;

a first flexible non-conductive surface positioned adjacent said rigid backing member and having switch contacts positioned thereon;

an insulating spacer positioned adjacent said first non-conductive surface and having apertures therein in registry with said switch contacts;

a second flexible non-conductive surface positioned adjacent said insulating spacer and having switch contactors positioned thereon in registry with said apertures in said spacer, whereby depression of each of said switch contactors brings it into contact with a corresponding one of said switch contacts;

a thin metal sheet overlying and adjacent to said second flexible non-conductive surface, said metal sheet having indicia thereon arranged in registry with corresponding switch contactors on said second flexible non-conductive surface such that depression of said metal sheet in the area of said indicia causes a corresponding switch contactor to engage a corresponding switch contact, said metal sheet having sufficient stiffness whereby the depression thereof is substantially imperceptible providing said touch panel with a hard, tactile feel.

* * * * *